US006328460B1

(12) United States Patent
Grossman et al.

(10) Patent No.: US 6,328,460 B1
(45) **Date of Patent: *Dec. 11, 2001**

(54) FOLDABLE WORKLIGHT WITH TRANSLUCENT LENS

(75) Inventors: Gary M. Grossman, Riverside, CT (US); Michael Ballone, New Providence, NJ (US); Thomas Van Dyk, Ramsey, NJ (US); John Kiely, Morristown, NJ (US)

(73) Assignee: Regent Lighting Corporation, Burlington, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/394,206

(22) Filed: Sep. 10, 1999

Related U.S. Application Data

(63) Continuation of application No. 08/927,429, filed on Sep. 11, 1997, now Pat. No. 6,050,710.

(51) Int. Cl.[7] ..... F21S 1/12
(52) U.S. Cl. ..... 362/427; 362/269
(58) Field of Search ..... 362/190, 191, 362/207, 269, 285, 287, 376, 382, 399, 427

(56) References Cited

U.S. PATENT DOCUMENTS

| | | | | |
|---|---|---|---|---|
| 3,265,880 | * | 8/1966 | Whitman | 362/207 |
| 5,381,322 | * | 1/1995 | Humphreys | 362/427 |
| 5,424,931 | * | 6/1995 | Wheeler | 362/437 |
| 5,558,430 | * | 9/1996 | Booty, Jr. | 362/190 |
| 5,746,495 | * | 5/1998 | Klamm | 362/285 |
| 6,050,710 | * | 4/2000 | Grossman et al. | 362/269 |

* cited by examiner

*Primary Examiner*—Y. My Quach-Lee
(74) *Attorney, Agent, or Firm*—Niro, Scavone, Haller & Niro

(57) ABSTRACT

The invention is a portable worklight that includes a housing, bulb, support base and a translucent lens covering a light emitting opening defined by the housing. Use of the translucent lens eliminates glare and shadowing by diffusing or randomly scattering light emitted from the bulb. In addition, the housing and support base may be configured such that the housing is rotatably mounted to the support base and the support base is further configured to allow the housing to be folded within the support base. This reduces the overall size of the light when it is placed in a stored position. The light may further include a male electrical jack that is used to provided power to the device by coupling an electrical cord to the jack.

4 Claims, 4 Drawing Sheets

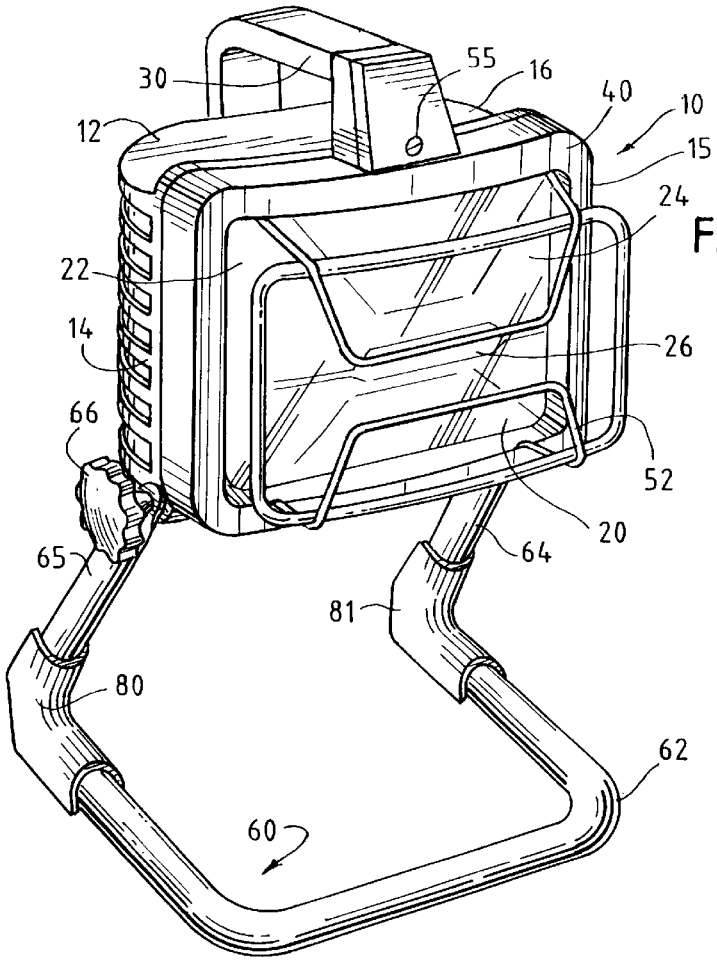
FIG. 1
FIG. 2
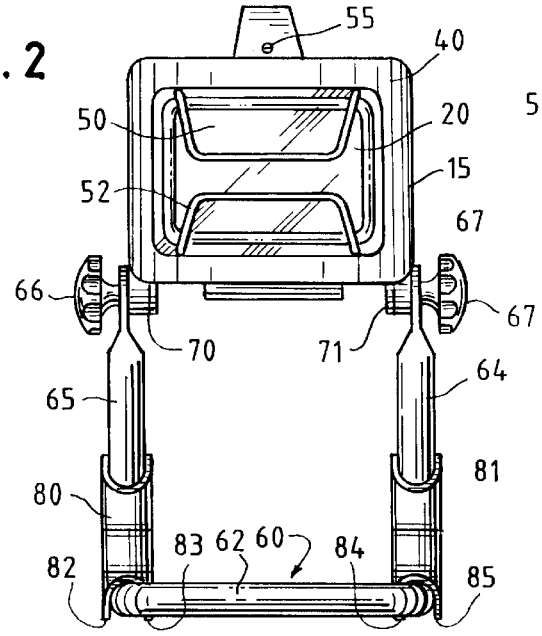
FIG. 3
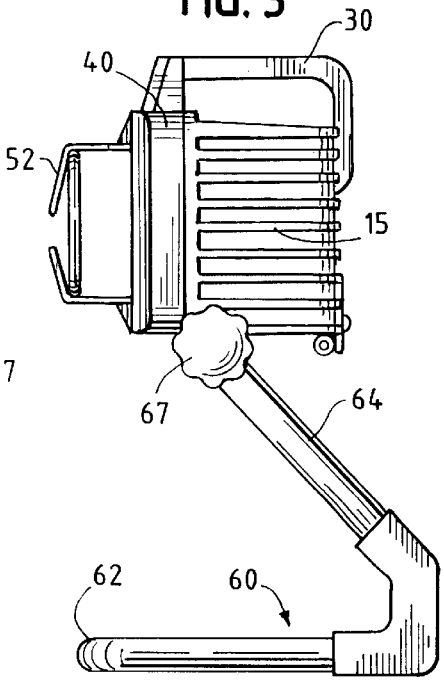

FOLDABLE WORKLIGHT WITH TRANSLUCENT LENS

This is a continuation of application Ser. No. 08/927,429 filed Sep. 11, 1997 which is now U.S. Pat. No. 6,050,710.

BACKGROUND OF THE INVENTION

The present invention relates to a portable worklight for illuminating an object. More particularly, the worklight of the present invention provides a light that illuminates a large flat surface, such as a wall, free from the glare and shadows which are typically associated with by portable lights. The present invention does so by providing a translucent lens which diffuses or randomly scatters the light emitted during operation. This feature is particularly useful to painters and other tradesmen that require a uniformly lit work surface that is free from glare and shadows which may hide imperfections in the surface or in the actual work being performed. In addition, the device is more convenient to use and store because its design permits it to be folded during storage and the need to store an electrical cord is also eliminated through the use of male electrical jack.

SUMMARY OF THE INVENTION

The invention overcomes a number of deficiencies in the prior art. First, the device minimizes the glare and shadows created on the work surface which are typically associated with portable worklights. Second, the device further improves upon prior worklight designs by providing a device that is reducible in size when placed in a stored position. In one embodiment of the present invention, the invention includes a housing in which the bulb is located, a support base and a translucent lens covering the light emitting opening defined by the housing. Use of the translucent lens eliminates the creation of glare and shadowing by randomly scattering the light emitted.

In another embodiment, the housing and support base are configured such that the housing is rotatably mounted to said support base. In addition, the support base is further configured to allow the housing to be folded within the support base to allow the overall size of the device to be reduced when placed in a stored position.

In yet another embodiment of the present invention, the device includes a male electrical jack. Power is provided to the device by coupling an electrical cord to the jack. This eliminates the need to manufacture and store an additional electrical cord with the device.

BRIEF DESCRIPTION OF THE DRAWINGS

FIG. 1 is a perspective view of the invention with the lens removed;

FIG. 2 is a front view of the embodiment shown in FIG. 1 with the lens included;

FIG. 3 is a left view of the embodiment shown in FIG. 1;

DESCRIPTION OF THE PREFERRED EMBODIMENT

As shown in FIG. 1, portable worklight fixture 10 comprises a housing 12 in which a halogen bulb 26 is located.

Figure 4:
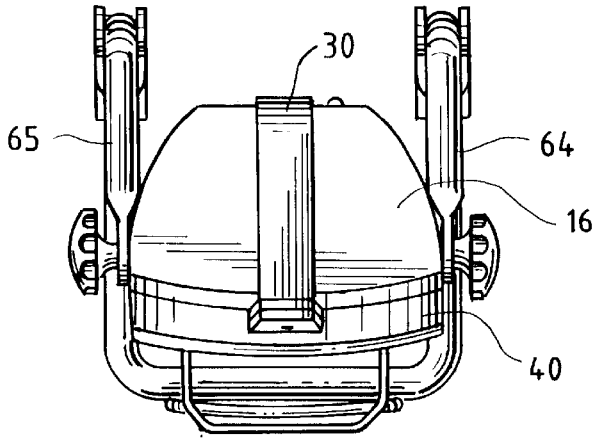
FIG. 4 is a top view of the embodiment shown in FIG. 1.
Figure 5:
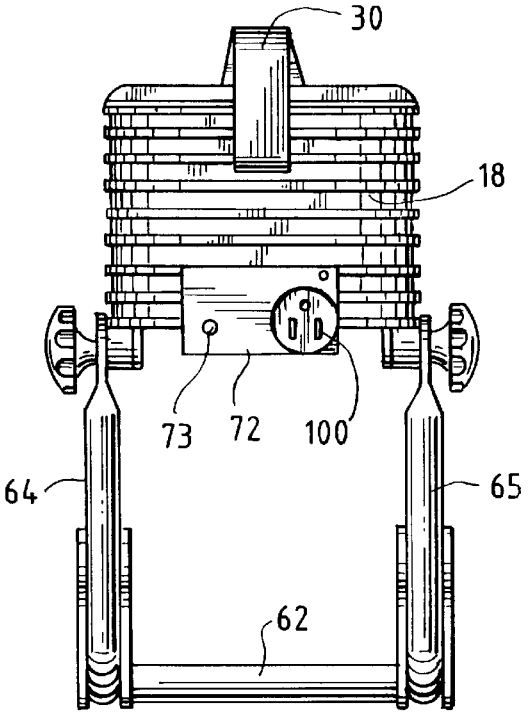
FIG. 5 is a back view of the embodiment shown in FIG. 1.
Figure 6:
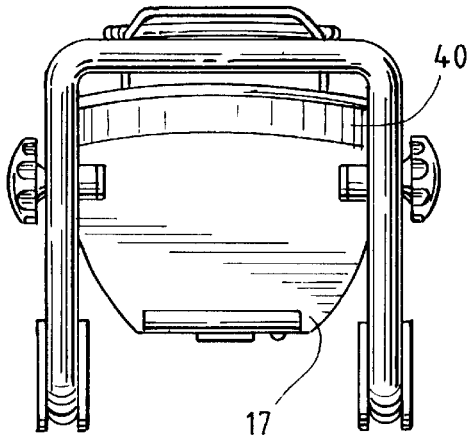
FIG. 6 is a bottom view of the embodiment shown in FIG. 1.

Housing 12 is comprised of opposing side walls 14 and 15 (shown in FIGS. 1 and 2) as well as top wall 16 (shown in FIGS. 1 and 4), bottom wall 17 (shown in FIG. 6), and back wall 18 (shown in FIG. 5). Walls 14–18 form cavity 22 in which bulb 26 and reflector 24 are housed. Reflector 24 reflects light emanating from bulb 26. Walls 14–17 also define a light emitting opening 20.

Located on top wall 16 is handle 30 which may be affixed to housing 12 or integrally molded with the housing. Handle 30 assists in transporting and positioning the device by providing a convenient surface which may be grasped by the end-user.

Circumscribing opening 20 is frame 40 which is affixed to housing 12 by a hinge (not shown) that may be located on anyone of walls 14–17, but preferably on the outer edge of bottom wall 17. As shown in FIG. 2, frame 40 contains translucent lens 50 which is sized to cover light emitting opening 20. Also located on frame 40 is grill 52 which may be made of wire or some other suitable material. As shown in FIG. 3, grill 52 extends outwardly from frame 40. Frame 40 is also affixed to housing 12 by fastener 55 which is shown in FIGS. 1 and 2 as fastening frame 40 to handle 30 of housing 12. Affixing frame 40 to housing 12 in the manner described provides access to cavity 22 for the replacement of bulb 26 through the hinged operation of the frame.

Supporting housing 12 in an operational or standing position is support base 60 which is comprised of a tubular frame. As shown in FIG. 1, base 60 has a lower support portion 62 that rests flat on a support surface. To provide added stability on a flat support surface covers 80 and 81, having planar edges 82–85, may be affixed to support 60. Although portion 62 is shown as being generally U-shaped, other configurations may also be used.

As also shown in FIG. 1, base 60 also includes upwardly extending legs 64 and 65 which may be either affixed to support 60 or integrally formed from support 60. Legs 64 and 65 are located at the distal ends of lower portion 62 and are angled to extend towards the center of U-shape portion 62 as shown in FIG. 3. Positioning legs 64 and 65 in this manner positions housing 12 over the center of support 60 which helps to balance and stabilize the device when placed in an operational position.

Housing 12 is affixed to base 60 by extending headed fasteners 66 and 67 through legs 64 and 65 and into internally threaded portions located on bosses 70 and 71 that extend downwardly from housing 12. Affixing housing 12 to base 60 in this manner allows housing 12 to be rotated about the axis formed by fasteners 66 and 67. This, in turn, provides for the rotational adjustment of light.

Figure 8:
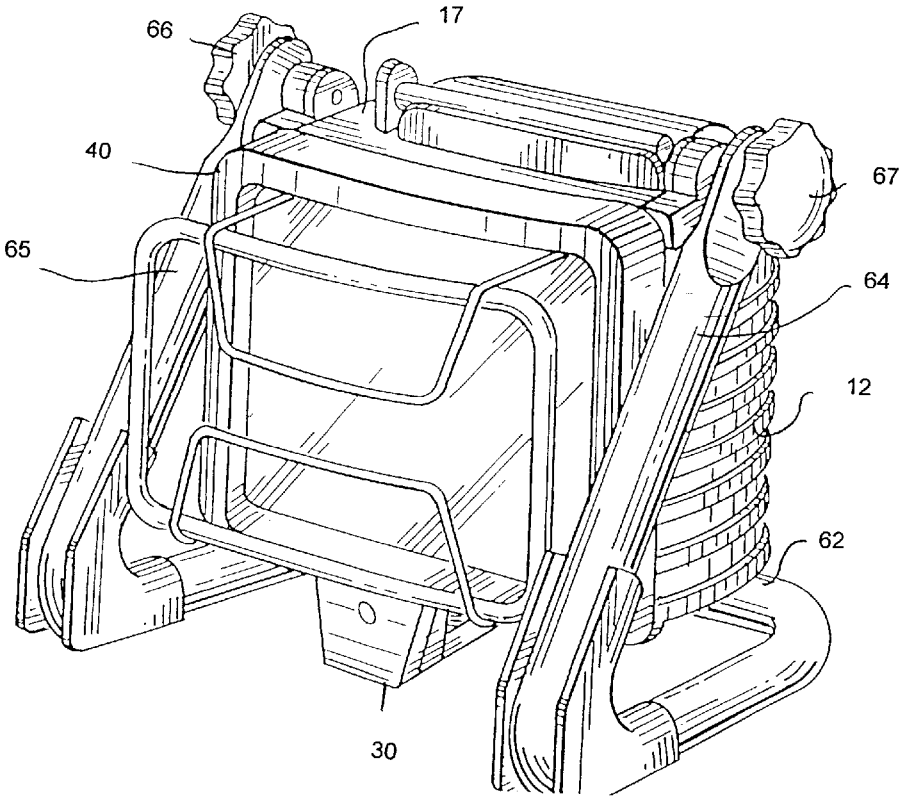
FIG. 8 is a perspective view of the invention showing the device in a stored position.

As shown in FIG. 8, the rotational movement of housing 12 further allows housing 12 to be folded down into base 60 when the worklight is to be placed in a stored position. This provides for convenient and compact storage of the device since it virtually halves the amount of space occupied by the worklight when it is placed in the stored position. To enable the worklight to fold upon itself, the height of legs 64 and 65 needs to be slightly greater than the overall height of the worklight as measured from bottom wall 17 to the top of handle 30. In addition, the width between the legs must also be slightly greater than the overall width of housing 12 as well.

Figure 7:
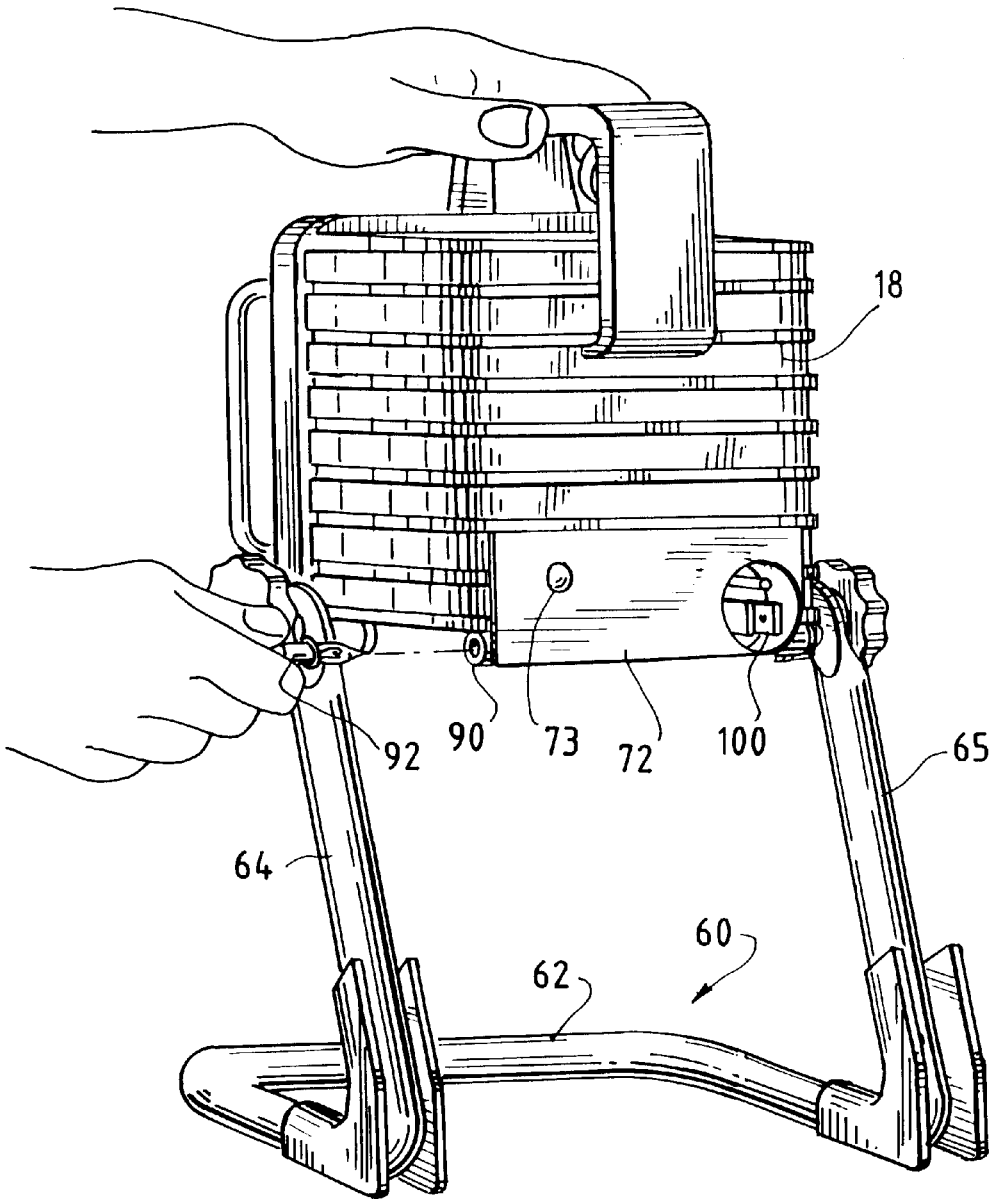
FIG. 7 is a back left perspective view of the embodiment shown in FIG. 1.

Power is supplied to bulb 26 by connecting a standard extension cord to male electrical jack 100 which is located on switch box 72 on back wall 18 as shown in FIGS. 5 and 7. Bulb 26 is, in turn, connected to the output side of a switch 73 located in switch box 72. Switch 73 may also act as a dimmer to increase the versatility of the worklight.

Using a standard extension cord with the device achieves a number of benefits. First, it lowers the cost of manufacture since. an electric cord need not be provided with the device. Second, it also makes the device more compact when placed in a stored position since the absence of a cord minimizes the amount of space occupied by the worklight.

Emitting light through translucent lens 50 eliminates the glare and shadows normally created by the use of a clear lens. This makes the device particularly useful in applications involving the repair and painting of flat surfaces such as walls where glare and shadows may conceal small imperfections in the work surface or the actual work performed. Shadows are eliminated because the translucent lens diffuses or scatters light in random directions. The translucent lens of the device may be made by water grinding a piece of glass but other known methods may be employed as well.

Finally, as shown in FIG. 7, the device also includes a light bulb storage tube 90 which is affixed to or molded into housing 12. The ability to have spare bulb 92 accompany the device further enhances the useful features of the device.

While the invention has been described with reference to a specific halogen worklight fixture embodiment thereof, it will be appreciated that the invention applies to quartz worklight fixtures and that numerous variations, modifications, and embodiments are possible, and accordingly, all such variations, modifications, and embodiments are to be regarded as being within the spirit and scope of the invention.

What is claimed is:

1. A portable worklight fixture comprising:

a housing adapted to receive a light source and having opposing walls forming a cavity and a light emitting opening;

a reflector mounted within said cavity for reflecting light emitted by said light source;

a support base comprising a U-shaped frame having two opposingly spaced apart distal legs located at the terminal ends of the U-shape frame that extend upwardly towards an interior portion of said U-shape frame, said housing rotatably mounted to said distal legs; and said support base is configured to allow said housing to fold within said support base by having a length of each of said legs greater than a height of the housing and a distance between the legs that are spaced apart greater than a width of the housing.

2. The portable worklight fixture of claim 1 further including a storage tube located on said housing that houses a spare light source.

3. The portable worklight fixture of claim 1 further including a translucent lens covering said light emitting opening, said lens diffuses light emitted from said light source.

4. The portable worklight fixture of claim 1 further including a male electrical jack located on said housing which is in electrical communication with said light source.

* * * * *